US006579379B2

(12) United States Patent
Noble

(10) Patent No.: US 6,579,379 B2
(45) Date of Patent: Jun. 17, 2003

(54) METHOD OF WASHING THE MEDIA BED OF A POLLUTION ABATEMENT REACTOR

(75) Inventor: Jerry Wayne Noble, South Lyon, MI (US)

(73) Assignee: Durr Environmental, Inc., Wixom, MI (US)

( * ) Notice: Subject to any disclaimer, the term of this patent is extended or adjusted under 35 U.S.C. 154(b) by 77 days.

(21) Appl. No.: 09/821,971

(22) Filed: Mar. 30, 2001

(65) Prior Publication Data

US 2002/0139398 A1 Oct. 3, 2002

(51) Int. Cl.[7] ..... B08B 3/02; B08B 3/04

(52) U.S. Cl. ..... 134/18; 134/22.1; 134/24; 134/26; 134/167 R; 134/168 R

(58) Field of Search ..... 134/18, 22.1, 24, 134/26, 167 R, 168 R

(56) References Cited

U.S. PATENT DOCUMENTS 4,307,773 A * 12/1981 Smith ..... 165/104.16
5,904,751 A * 5/1999 Van Niekerk ..... 95/212
6,125,864 A * 10/2000 Morikawa et al. ..... 134/167 R
6,322,356 B1 * 11/2001 Gupta et al. ..... 432/179

* cited by examiner

*Primary Examiner*—Zeinab El-Arini
(74) *Attorney, Agent, or Firm*—Howard & Howard

(57) ABSTRACT

A method for washing the media bed of a gas pollution abatement reactor which includes using a bed washer apparatus which includes a continuous tubular manifold having a plurality of spaced downwardly directed nozzles directing liquid onto the bed supported on a frame, a drive wheel supports the frame, and a motor driving the drive wheel in at least two directions inside the reactor. The manifold is connected to a source of liquid and the apparatus includes directional control switches for reversing the direction of the drive wheel. In this method the reactor is first taken offline and the media bed is cooled to ambient temperature. The components of the washer are disassembled and then re-assembled inside the reactor and the manifold is connected to a source of wash liquid. The washer traverses the media bed, uniformly washing the media bed to remove particulate contaminants without requiring personnel inside the reactor while the media is being washed.

11 Claims, 4 Drawing Sheets

METHOD OF WASHING THE MEDIA BED OF A POLLUTION ABATEMENT REACTOR

BACKGROUND OF THE INVENTION

The present invention relates to an improved method of washing the media bed of a gas pollution abatement reactor, such as a regenerative thermal oxidizer or a selective catalytic reduction system, and a bed washer apparatus.

Regenerative thermal oxidizers or RTOs are now widely used for oxidizing gaseous pollutants including volatile organic compounds, such as hydrocarbons, in waste or exhaust gas streams. A typical regenerative thermal oxidizer includes at least two heat exchange chambers each having a heat exchange media bed therein and a combustion chamber located above the heat exchange media communicating with the heat exchange chambers. The waste gas stream is directed alternatively or periodically into one of the heat exchange chambers which has been previously heated and wherein the gaseous pollutants are oxidized. The gas then flows into the combustion chamber, wherein any remaining gaseous pollutants are oxidized. The combustion chamber is also used to preheat the gas flowing through the regenerative thermal oxidizer during start-up and to oxidize any remaining pollutants in the waste gas stream. The cleansed heated gas then flows into the second heat exchange chamber, heating the media bed in the second heat exchange chamber and the cleansed gas from the second media bed is vented to atmosphere. The gas flow through the regenerative thermal oxidizer is then reversed, such that the waste gas stream flows into the heat exchange media in the second heat exchange chamber, oxidizing the pollutants, etc. A regenerative thermal oxidizer thereby conserves heat resulting in a more efficient gas pollution abatement system.

A regenerative thermal oxidizer of the type described herein may include two or three heat exchange chambers, wherein the third chamber serves as a purge chamber. A series of control valves then directs the gas through the heat exchange chambers as described above. By alternating the flow through the regenerative thermal oxidizer through the heat exchange chambers, the pollutants in the process or exhaust gas is removed and oxidized without exhausting pollutants to the atmosphere and the heat exchange media is periodically cleaned.

The heat exchange media in the media bed may comprise relatively small ceramic elements, generally saddle shaped ceramic elements, or the media bed may be formed of stacked ceramic blocks each having small continuous passages therethrough. The ceramic media may also include or be coated with a catalyst resulting in a catalytic reaction within the chamber to remove gaseous pollutants. Where the media includes a catalyst, the gaseous pollutant abatement system is generally referred to as a selective catalytic reduction apparatus or SCR system used primarily to treat NOx, including NO and $NO_2$. The ceramic media may be coated with a suitable catalyst or the catalyst may be mixed with the ceramic matrix prior to firing. Typical catalysts include noble metal catalysts, such as platinum, and base metal catalysts, such as vanadium or manganese oxide or Zeolite. A typical SCR system includes only one reaction chamber filled with a catalytic media bed as described. The gas to be treated flows through the bed of catalytic media in the reaction chamber where the NOx is reduced to nitrogen gas and non-polluting oxides.

As used herein, the term "gas pollution abatement reactor" is intended to include both RTOs and SCRs and other gas pollution abatement apparatus having a media bed, wherein the media bed is heated to oxidize or react with the gaseous pollutants, thereby removing the pollutants prior to venting the gas to atmosphere. However, in many real world applications of these systems, the industrial process gas emissions further contain solid particulate material in addition to the gas phase pollutants the abatement reactor is intended to destroy. These particulates can accumulate in the media bed in sufficient quantities such that the accumulated particulate material will cause an increase in the airflow resistance through the media bed, increasing the pressure drop across the media bed, thereby restricting the airflow capacity of the system and preventing the process equipment from operating properly. Because these particulates are endemic to many real world applications and they can cause the gas pollution abatement reactor to become inoperative, techniques have been developed to clean these particulates from the media bed.

The presently preferred method of cleaning particulates from the media bed is water washing. Water washing is used primarily to clean non-burnable particulate accumulations from RTOs and non-reactive particulates from SCRs. Burnable particulates are typically cleaned from the media bed of an RTO using a "bake out" technique. Conventional water washing is accomplished by the following procedure. First, the gas pollution abatement reactor is taken "offline," shut down and cooled to ambient temperature. The access door located above the media bed is then opened and the atmosphere is checked as required for personnel entry. The media bed is then washed, typically using a fire hose connected to a supply of wash water. The wash water is then sprayed over the media bed by personnel standing on the media bed who manually distribute the wash water over the media bed by moving the hose from place to place. After the washing is completed, the media bed is dried and reheated prior to placing the gas pollution abatement reactor back in service.

There are several important disadvantages of this conventional washing technique. First is worker safety. If there are any "hot spots" in the media bed when the washing is started and the water is directed onto these hot spots, steam will be generated and released. This can cause hazardous temperatures. In addition, the steam can fog the workers' eyewear, making it difficult for them to exit. Depending on how the reaction media is cooled, these hot spots may be well below the upper surface of the media and not apparent upon inspection. Another disadvantage of this water washing technique is the potential for the workers to wet or damage the ceramic fiber insulation inside the combustion chamber of an RTO. If this ceramic fiber insulation is wetted, it can sag or shrink, creating gaps which will lead to hot spots on the outside skin of the reaction chamber. These hot spots can lead to unnecessary heat loss, cosmetic damage to the exterior finish of the housing, and possible corrosion of the outer shell. Another disadvantage of this method is the potential for poor distribution of the wash water over the surface of the media bed. Because the workers must manually move the hose from place to place, there is the potential for some places being missed and other places washed more than necessary. Thus, this method is wasteful of wash water and can lead to incomplete washing.

There is, therefore, a long felt need to improve the method of washing the media bed of a gas pollution reactor such as an RTO or SCR which assures personnel safety, reduces damage to the ceramic fiber lining of the housing, and assures even distribution of wash water over the media bed. The method of washing the media bed of a gas pollution abatement reactor and bed washer apparatus of this invention solves these problems by eliminating the need of a worker being located within the reactor housing during washing, and by utilizing a bed washer which assures even distribution of the wash water over the media bed without spraying the ceramic fiber installation inside the housing.

SUMMARY OF THE INVENTION

As set forth above, the present invention relates to a method of washing the reaction media bed of a gas pollution abatement reactor and an apparatus or bed washer for washing the media bed which eliminates the requirement for personnel to be located within the housing during washing and which assures even distribution of the wash water over the surface of the media bed without spraying the insulation during washing. A typical gas pollution abatement reactor of the type described above includes a housing having generally parallel side walls, opposed end walls and an access door located above the media bed. The media bed may be comprised of relatively small particles of ceramic media or stacked ceramic blocks. The end walls of the housing are typically semicircular or arcuate, but the chamber located above the media may also be rectangular having planar end walls. A typical reaction chamber has parallel side walls and semicircular end walls having a width of about 9 to 12 feet and a length of 15 to 30 feet. The housing further has an access door typically two foot by two foot located above the top surface of the media bed by one to two feet.

The method of washing the reaction media bed of a pollution abatement reactor of this invention includes the following steps. First, the pollution abatement reactor is shut down and the media bed is cooled to generally ambient temperature. Second, the access door is opened and the atmosphere is checked as required for personnel entry as described above. Third, a bed washer is received through the access door and assembled on the top surface of the media bed. In the disclosed embodiment of the bed washer, the bed washer is easily disassembled sufficiently to be received through the relatively small access door of the housing, but the bed washer may also be folded. The bed washer includes a tubular manifold having a plurality of downwardly directed spaced nozzles and a drive wheel for directing the manifold to traverse the media bed. Once the bed washer is assembled, the manifold is connected to a source of washing liquid under pressure and the personnel then exit the housing through the access door prior to washing the media bed. The bed washer is then operated by personnel located outside the housing to traverse the media bed and the media bed is uniformly washed by the washer liquid directed through the downwardly directed nozzles as the bed washer traverses the media bed. In the event that the media bed includes hot spots, the workers are not subjected to steam and the wash water is evenly distributed over the media bed without spraying the side walls of the housing which typically include ceramic insulation as described above. The bed washer is then removed from the housing through the access door by either disassembling the bed washer or folding. After the washing is complete, the media bed is dried and the pollution abatement reactor is activated to heat the media bed to place the reactor back in service.

The preferred embodiment of the bed washer as described above includes a continuous tubular manifold having generally parallel side portions, opposed end portions and a plurality of spaced downwardly directed nozzles directing wash water under pressure on the surface of the media bed. In the most preferred embodiment, the bed washer includes directional control switches at the opposed end portions of the manifold connected to a motor which drives the drive wheel, such that the bed washer reverses direction when the directional control switches engages an end wall of the gas pollution abatement reactor. In the most preferred embodiment, the width of the bed washer measured between the side portions of the manifold is generally equal to the width of the housing such that the entire surface of the media bed is washed with each pass of the bed washer. The side portions of the tubular manifold may also include rub rails, which may be adjustable to accommodate variations in the width of the housings. In the disclosed embodiment, the continuous tubular manifold is supported by a frame extending generally perpendicular to the side portions of the tubular manifold and the drive wheel is rotationally supported by the frame. A motor is connected to the drive wheel and the motor is connected to the directional control switches, which are pneumatic in the disclosed embodiment, to reverse the direction of the bed washer as described. The tubular manifold is also supported by a plurality of stabilizer wheels. The bed washer assembly may be easily disassembled for receipt of the bed washer through the access door of the housing by disconnecting union connections between the end and side portions of the manifold which may be flexible to permit folding of the manifold.

In the most preferred embodiment of the bed washer and method of this invention, the end portions of the tubular manifold are configured to be received in the end walls of the housing. Thus, where the end walls of the housing are semi-circular, the end portions of the tubular manifold are also semi-circular. Alternatively, where the end walls of the housing are planar, the end portions of the tubular manifold are also planar.

The method of washing a media bed of a gas pollution abatement reactor of this invention thus eliminates the problems associated with the current washing method. The workers are located outside the housing when the media bed is washed, eliminating concerns regarding hot spots and the resultant steam, as described above. Further, the media bed is uniformly washed without spraying the side walls of the housing which are normally insulated with ceramic fiber insulation as described above. The bed washer of this invention may be easily disassembled or folded for insertion into the housing through the relatively small access door located above the media bed and the washing procedure may be accomplished in less time than the conventional method described above. The wash liquid will dissolve salts of sodium and potassium chloride for example, entrained in the exhaust gas received by the pollution abatement reactor and wash small particulate material through the media bed which may be collected below the bed. Other advantages and meritorious features of the present invention will be more fully understood from the following description of the preferred embodiments, the appended claims and the drawings, a brief description of which follows.

DETAILED DESCRIPTION OF A PREFERRED EMBODIMENT

Figure 4:
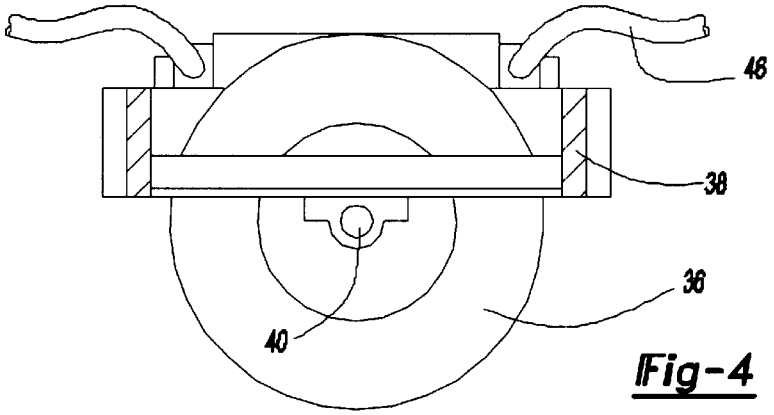
FIG. 4 is a side cross-sectional view of FIG. 3 in the direction of view arrows 4—4.
Figure 3:
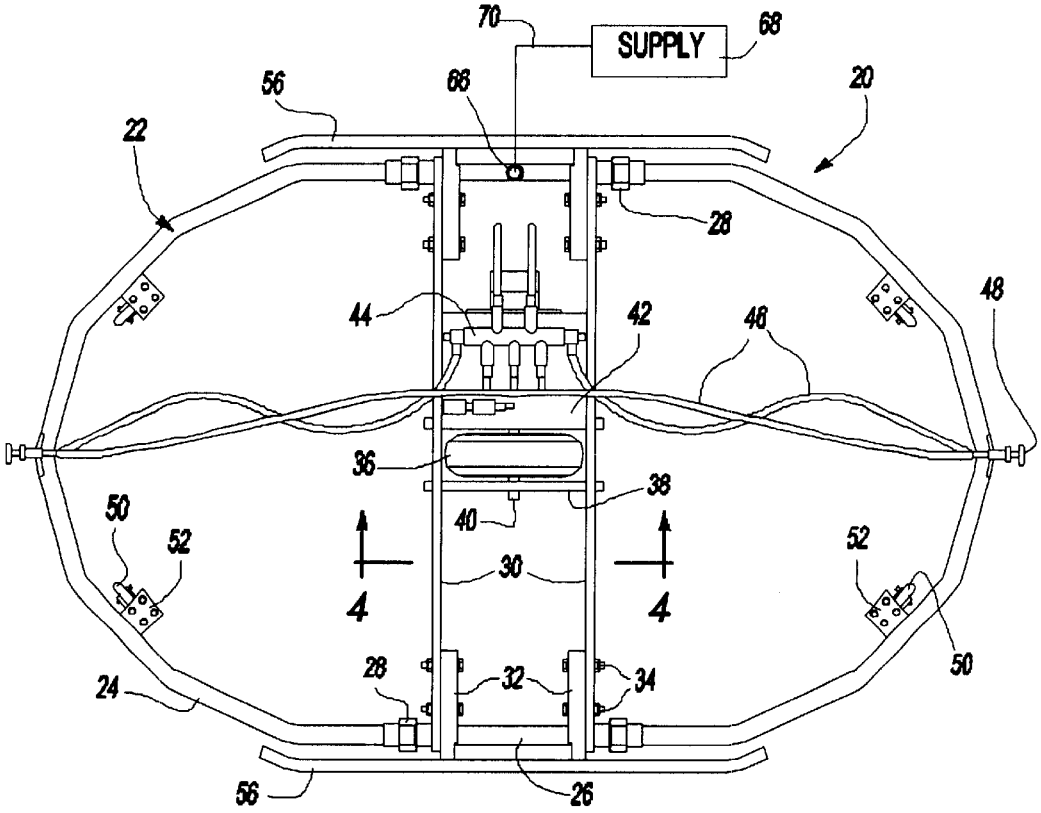
FIG. 3 is a top view of a preferred embodiment of the bed washer.
Figure 5:
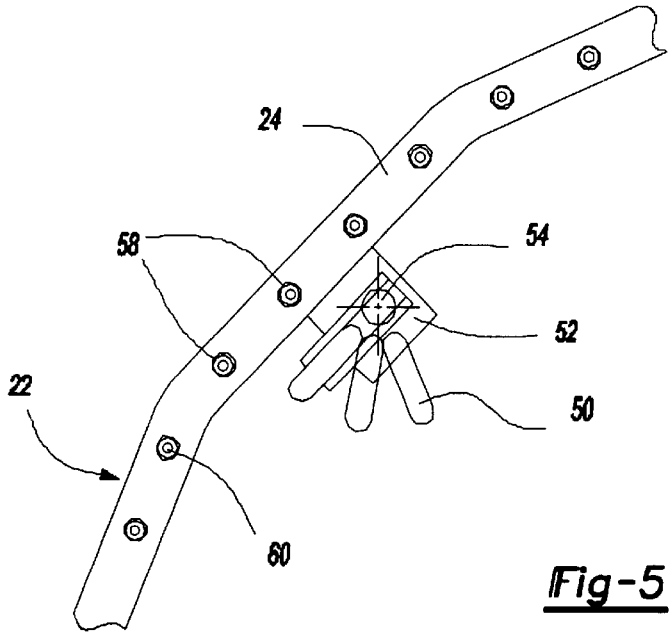
FIG. 5 is a partial bottom view of the tubular manifold illustrating the spray nozzles.

Before describing the method of washing the media bed of a gas pollution abatement reactor of this invention, a preferred embodiment of the bed washer 20 will now be described with particular reference to FIG. 3. The bed washer 20 includes a continuous tubular manifold 22 having end portions 24 and side portions 26. The side portions 26 are connected to the end portions 24 by conventional threaded union connections or couplings 28 which may be flexible for folding. The manifold is supported on frame members 30 by opposing brackets 32 which are bolted to the frame members by bolts 34. The frame members 30 and manifold 22 are supported by a drive wheel 36 by bracket 38 as best shown in FIG. 4 and the drive wheel 36 is rotationally supported on a shaft 40. The shaft 40 is connected to a motor and gear box 42, which in the disclosed embodiment is pneumatic. The motor and gear box 42 is connected to a pneumatic directional control valve 44 and the control valve 44 is connected by pneumatic tubes 46 to the directional control switches 48 located at a midportion of the end portions 24. The manifold 22 is also supported by stabilizer wheels 50 connected to the tubular manifold by brackets 52 and pivot pin 54 as shown in FIG. 5. The preferred embodiment of the bed washer also includes opposing guide rail 56, each of which is connected to one of the brackets 32 by welding or other suitable means. The distance between the guide rails 56 may be adjusted by adjusting the bolts 34 in slots in the frame members 30 (not shown).

Figure 2:
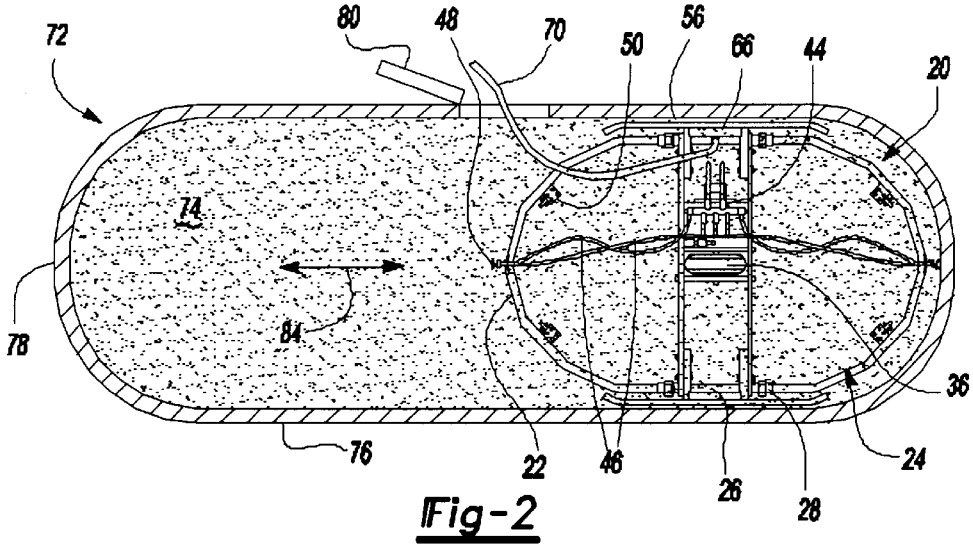
FIG. 2 is a top view of a bed washer assembled in the housing of a gas pollution abatement reactor.
Figure 6:
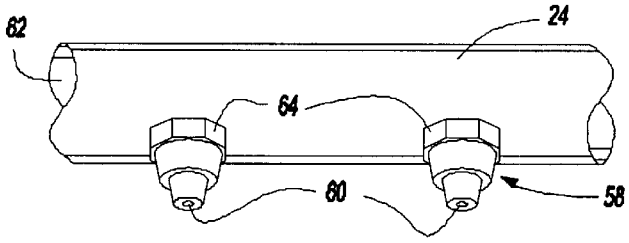
FIG. 6 is a perspective view of a portion of the tubular manifold further illustrating the nozzles.

The underside of the tubular manifold 22 includes a plurality of downwardly directed spaced nozzles 58 as best shown in FIGS. 5 and 6. Each of the nozzles includes a downwardly directed outlet 60 which communicates with the interior 62 of the tubular manifold, which in the disclosed embodiment is secured to the manifold by a lock nut 64 as shown in FIG. 6. The spray pattern and flow rate of the outlet 60 is chosen to accommodate a particular reactor design. The manifold is connected to a supply of wash water under pressure 68 as shown in FIG. 3 by a flexible hose 70 as best shown in FIG. 2. Having described the components of the bed washer 20, the method of washing the media bed of a pollution abatement reactor may now be described as follows.

Figure 8:
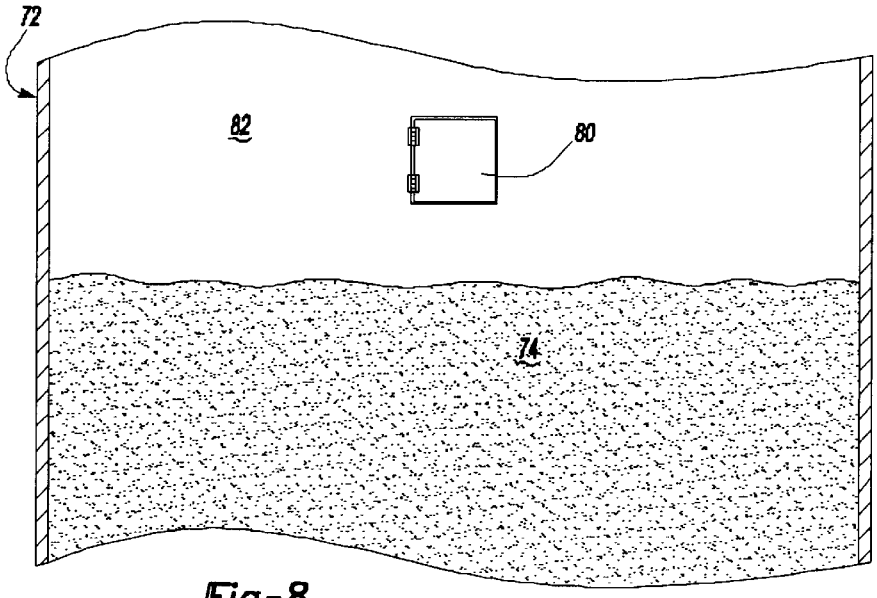
FIG. 8 is an internal cross-sectional view of the housing illustrating the access door.
Figure 9:
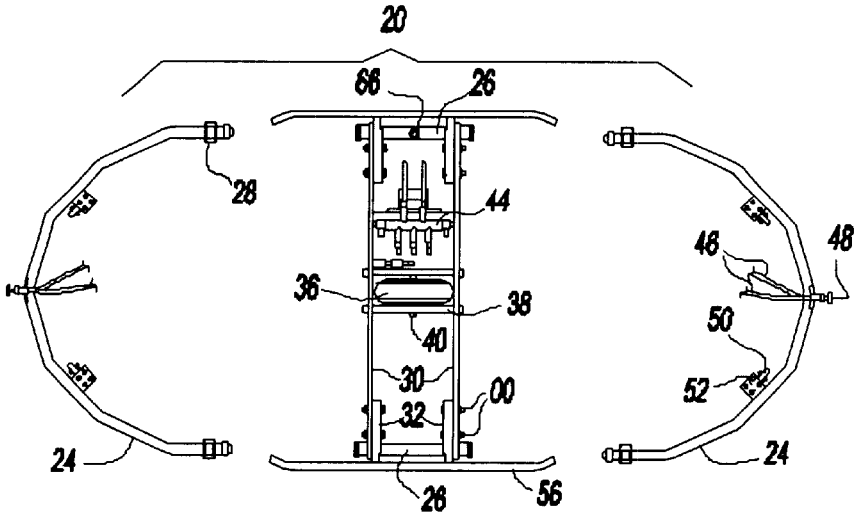
FIG. 9 illustrates the bed washer illustrated in FIGS. 1 to 5 above following disassembly of the bed washer.
Figure 10:
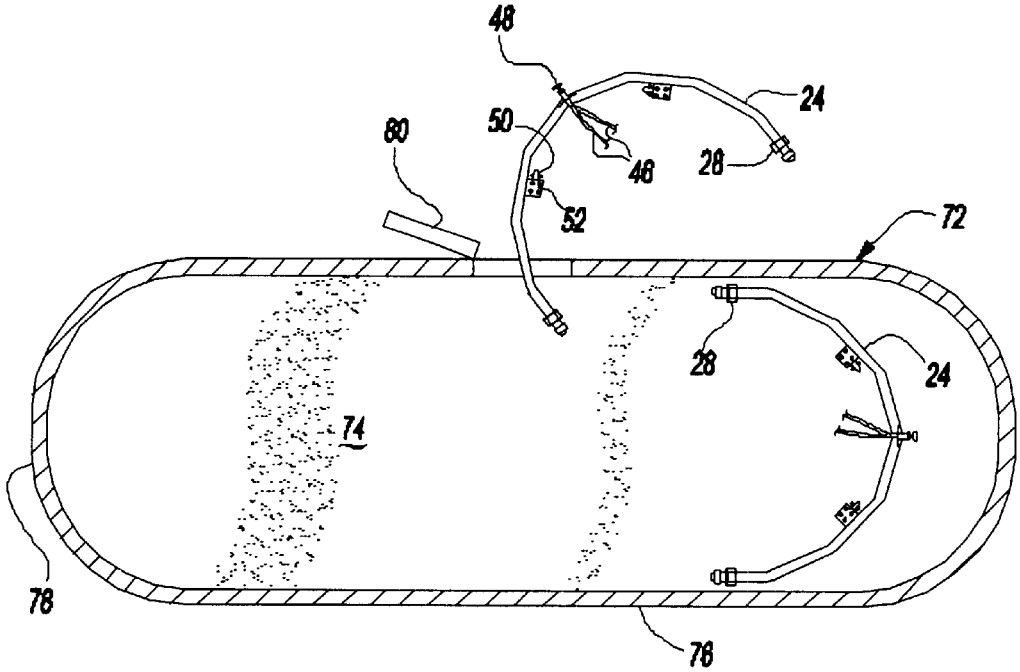
FIG. 10 illustrates insertion or removal of the components of the bed washer shown in FIG. 9 through the access door of the housing.

As described above, the method of washing the media bed of a gas pollution abatement reactor of this invention may be utilized with any conventional gas pollution abatement reactor including regenerative thermal oxidizers or RTOs and selective catalytic reduction systems or SCRs. Each of these gas pollution abatement reactors includes a housing 72 typically formed of sheet metal and containing a media bed 74 which may be formed of particulate ceramic material or ceramic blocks as described above. A typical housing of a gas pollution abatement reactor or apparatus includes generally parallel side walls 76 and end walls 78 which may be semi-circular as shown in FIG. 2. The housing 72 further includes an access door 80 as shown in FIG. 2 located above the media bed 74 as shown in FIG. 8. As described above, the access door 80 is relatively small as compared to the length and width of the housing 72 and the size of the media bed 74. Thus, in the preferred embodiment, the bed washer 20 is easily disassembled for insertion of the components through the access door 80 of the housing as shown in FIGS. 9 and 10. The disclosed embodiment of the bed washer 20 may be easily disassembled by unthreading the union connections or couplings 28 which interconnect the end portions 24 and the side portions 26 of the tubular manifold as shown in FIG. 9. The bed washer then includes three sections, including two end portions 24 and the central portion, which includes the center portions 26 of the tubular manifold, the frame members 30, the drive wheel assembly 36 and the directional control valve 44. These portions may then be received through the access door 80 as shown in FIG. 10 during insertion and removal of the bed washer 20 as required by the method of washing the media bed now described.

As described above, the media bed 74 is heated during operation of the pollution abatement apparatus. For example, in an RTO, the media bed 74 is heated to a temperature of about 1500° F. The first step of the method of this invention then includes taking the gas pollution abatement reactor "off line," shutting down the reactor, and allowing the media bed to cool down generally to ambient temperature. The access door 80 is then opened and the chamber 82 above the media bed 74 is checked as required for personnel entry. The components of the bed washer 20 are then received through the access door 80 as shown in FIG. 10 and assembled on the media bed as shown in FIG. 2. The bed washer in the disclosed embodiment is assembled by connecting the union connections or couplings 28 interconnecting the end portions 24 with the central portion 26 and forming a continuous tubular manifold as shown in FIG. 2. The inlet 66 of the manifold is then connected to a flexible hose 70 as shown in FIG. 2 and the hose 70 is connected to a source of wash water under pressure as shown in FIG. 3. The personnel who assembled the bed washer 20 then exit the housing through the access door 80 and the bed washer 20 is then ready for operation.

Figure 1:
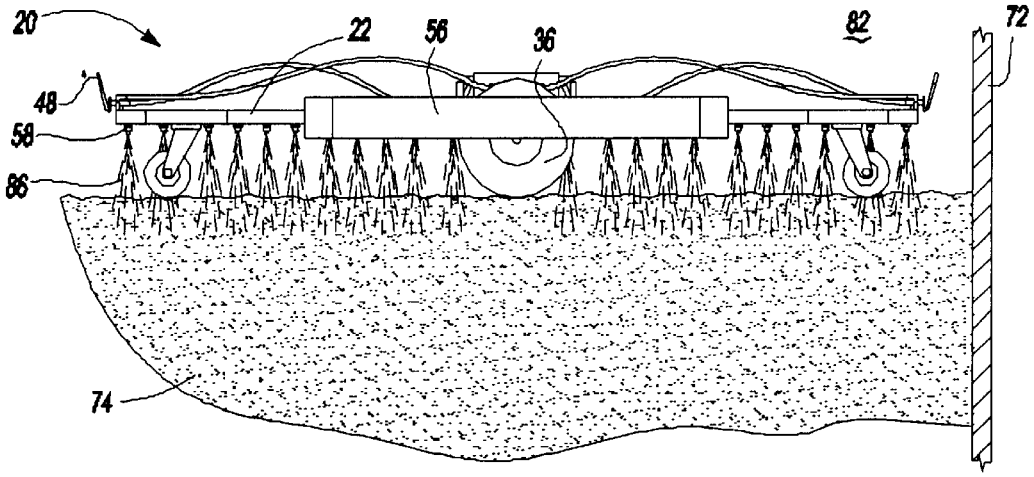
FIG. 1 is a side partially cross-sectioned view of the bed washer of this invention located on a particulate media bed, also illustrating the method of this invention.

In the preferred embodiment of the bed washer 20, the width of the bed washer measured between the side rails 56, where the bed washer includes side rails 56, is generally equal to the width of the pollution abatement reactor measured between the side walls 76 as shown in FIG. 2, such that the entire surface of the media bed 74 is washed with each pass of the bed washer 20. The pressurized wash fluid is then received through hose 70 to the inlet 66 of the now continuous tubular manifold 22 and the drive wheel 36 is driven by the motor and gear box 42 (FIG. 3) to drive the bed washer 20 over the media bed as shown by arrow 84. When one of the directional control switch 48 engages one of the end walls 78, a signal is received through pneumatic tubes 46 by the directional control valve 44, reversing the direction of travel of the bed washer as described above. During the traverse of the bed washer 20 over the media bed 74, the water wash liquid is sprayed onto the media bed as shown at 86 in FIG. 1. As described above, the water wash will dissolve the soluble salts collected in the media bed 74 and the insoluble particulates will be washed through the bed 74. In the most preferred method of washing the media bed 74 of the gas pollution abatement reactor of this invention, the bed washer 20 is permitted several traverses of the media bed 74 depending upon the quantity of particulate material in the bed 74. The bed washer 20 is then removed from the chamber 82 above the media bed 74 by disassembling the bed washer as shown in FIG. 9 and removing the components from the chamber 82 as shown in FIG. 10. The media bed 74 is then permitted to dry and the gas pollution abatement reactor may then be returned to operation by heating the bed 74 as described above.

Figure 7:
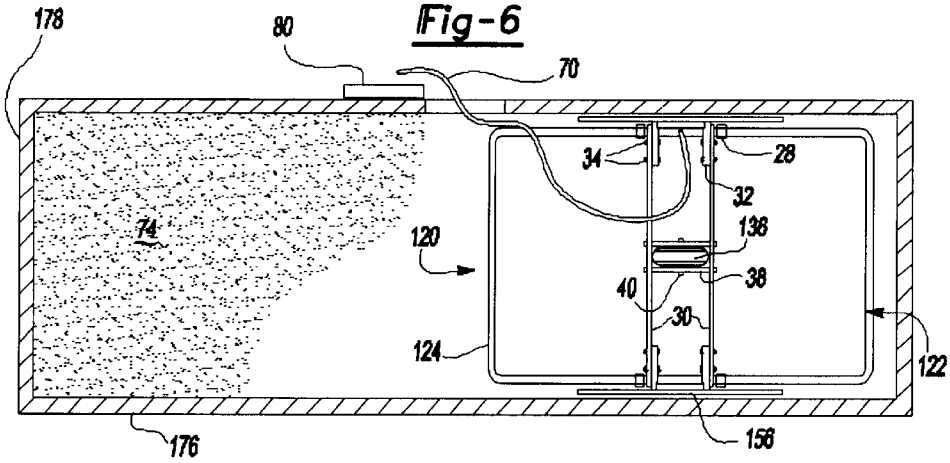
FIG. 7 is a top partially cross-sectioned view similar to FIG. 2 of an alternative embodiment of the bed washer for rectangular housings.

FIG. 7 illustrates an alternative embodiment of a bed washer 120 having a tubular manifold 122 including rectangular end portions 124 to accommodate a rectangular gas pollution abatement reactor having planar end walls 178. The bed washer 120 is otherwise identical to the bed washer 20 described above except that the guide rails 156 do not include arcuate end portions because the chamber is rectangular as shown. Otherwise, the bed washer 120 and method of washing the media bed 74 is identical to the bed washer 20 and method of washing the media bed described above and therefore no further explanation is required.

The method of washing the media bed 74 of a gas pollution abatement reactor and bed washer apparatus 20 of this invention therefore eliminates the problems associated with washing a media bed 74 described above. First, because no personnel are located in the housing 72 during the washing operation, no worker is exposed to steam in the event that there are hot spots in the media bed 74 which generate steam when the wash water 86 contacts a hot spot. The method and apparatus of this invention therefore improves personnel safety. Second, because the wash water 86 is directed solely on the surface of the media bed 74 by the downwardly directed nozzles 58, the likelihood of damage to any insulation material on the inside surface of the housing 72 is reduced or eliminated. Finally, because the nozzles 58 evenly distribute the wash water 86 on the surface of the media bed 74 at a reduced pressure as compared to a fire hose, the media bed is uniformly washed and the potential for some portions of the media bed 74 being missed by the washing procedure is reduced or eliminated. Thus, the method and apparatus of this invention solves the problems associated with conventional techniques of washing a media bed 74 of a gas pollution abatement apparatus.

As will be understood by those skilled in this art, various modifications may be made to the bed washer 20 and method of this invention within the purview of the appended claims. For example, the components of the bed washer shown in FIG. 9 may be interconnected by flexible couplings (not shown) and the manifold 22 by flexible hosing to simplify the assembly of the bed washer 20 in the housing 72. Further, an electric motor and gear box may be substituted for the pneumatic motor and gear box disclosed. The guiderails are optional, but included in the preferred embodiment. Finally, the bed washer 20 may be controlled to traverse the media bed 74 from side to side as well as from end to end by including a computer control. Having described the preferred embodiments of the bed washer 20 and method of washing a media bed 74 of a gas pollution abatement reactor, the invention is now claimed as follows.

What is claimed is:

1. A method of washing a reactor media bed inside a housing of a gas pollution abatement reactor, said housing having opposed substantially parallel side walls, opposed end walls and an access door located above said reactor media bed, said method comprising the following steps:

terminating operation of said gas pollution abatement reactor;

cooling said reactor media bed of said pollution abatement reactor to generally ambient temperature;

disposing components of a bed washer through said access door;

assembling said components of said bed washer on said reactor media bed, said bed washer including a tubular manifold having a plurality of downwardly directed spaced nozzles and a drive wheel directing said manifold to traverse said media bed;

connecting said tubular manifold to a source of wash liquid under pressure and said bed washer traversing said reactor media bed, thereby washing said reaction media bed;

removing said bed washer through said access door; and activating said gas pollution abatement reactor.

2. The method of washing the reaction media bed defined in claim 1, wherein said method includes disassembling said bed washer before disposing said bed washer through said access door of said housing.

3. The method of washing the reaction media bed as defined in claim 2, wherein said method includes disassembling said tubular manifold.

4. The method of washing the reaction media bed as defined in claim 1, wherein said bed washer includes directional control switches on opposed ends of said manifold, said method including driving said bed washer on said media bed to traverse said media bed until one of said directional control switches engages a wall of said housing, reversing the direction of said bed washer.

5. The method of washing the reactor media bed as defined in claim 4, wherein said tubular manifold has a width substantially equal to a width of said housing between said substantially parallel opposed side walls and said housing having a greater length, said method including driving said bed washer to traverse the length of said housing.

6. The method of washing the reaction media bed as defined in claim 1, wherein said method includes disassembling said bed washer before removing said bed washer through said access door.

7. A method of washing a ceramic media bed of a gas pollution abatement reactor, said gas pollution abatement reactor including a housing containing said ceramic media bed and said housing having an access door located above said ceramic media bed, said method comprising the following steps:

terminating operation of said gas pollution abatement reactor and allowing said ceramic media bed to cool to generally ambient temperature;

inserting a bed washer apparatus from outside said housing through said access door onto said ceramic media bed, said bed washer apparatus including a tubular manifold supported on wheels and having a plurality of spaced nozzles;

configuring said tubular manifold of said bed washer apparatus to direct said plurality of spaced nozzles toward said ceramic media bed;

connecting said tubular manifold to a source of washing liquid under pressure located outside said housing;

moving said bed washer apparatus over said ceramic media bed, thereby washing said ceramic media bed of particulate contaminants;

removing said bed washer apparatus from said housing through said access door; and resuming operation of said gas pollution abatement reactor.

8. The method of washing a ceramic media bed as defined in claim 7, wherein said bed washer apparatus includes a dimension greater than said access door, said method including disassembling said bed washer apparatus prior to inserting said bed washer apparatus through said access door and assembling said bed washer apparatus on said ceramic media bed.

9. The method of washing a ceramic media bed as defined in claim 7, wherein one of said wheels of said bed washer apparatus includes a motor, said method including operating said motor to drive said bed washer apparatus over said ceramic media bed.

10. The method of washing a ceramic media bed as defined in claim 9, wherein said bed washer apparatus includes a directional control switch connected to said motor, said method including driving said bed washer apparatus across said ceramic media bed in one direction to engage said directional control switch against a wall of said housing, said directional control switch then reversing said motor to drive said bed washer apparatus in an opposite direction.

11. The method of washing a ceramic media bed as defined in claim 7, wherein said housing has opposed planar side walls and opposed end walls, wherein a length of said housing measured between said opposed end walls is greater than a width of said housing measured between said opposed planar side walls, and said bed washer apparatus having a width substantially equal to said width of said housing, said method including aligning said width of said bed washer apparatus with said width of said housing and moving said bed washer apparatus between said opposed end walls of said housing.

* * * * *

UNITED STATES PATENT AND TRADEMARK OFFICE

CERTIFICATE OF CORRECTION

PATENT NO. : 6,579,379 B2
DATED : June 17, 2003
INVENTOR(S) : Jerry Wayne Noble

It is certified that error appears in the above-identified patent and that said Letters Patent is hereby corrected as shown below:

Column 8,
Line 10, delete “reaction” and insert -- reactor --.

Signed and Sealed this

Twenty-third Day of September, 2003

JAMES E. ROGAN
*Director of the United States Patent and Trademark Office*